US008651278B2

(12) United States Patent
Pitt

(10) Patent No.: US 8,651,278 B2
(45) Date of Patent: Feb. 18, 2014

(54) SHOCK-PROTECTING PACKAGING

(75) Inventor: Jeffrey Graham Pitt, Cornwall (GB)

(73) Assignee: Protective Packaging Systems Limited, Fowey, Cornwall (GB)

( * ) Notice: Subject to any disclaimer, the term of this patent is extended or adjusted under 35 U.S.C. 154(b) by 127 days.

(21) Appl. No.: 13/123,279

(22) PCT Filed: Oct. 9, 2009

(86) PCT No.: PCT/GB2009/002414

§ 371 (c)(1),
(2), (4) Date: May 31, 2011

(87) PCT Pub. No.: WO2010/041024

PCT Pub. Date: Apr. 15, 2010

(65) Prior Publication Data

US 2011/0233099 A1 Sep. 29, 2011

(30) Foreign Application Priority Data

Oct. 9, 2008 (GB) ..... 0818508.4

(51) Int. Cl.
*B65D 81/02* (2006.01)
*B65D 85/20* (2006.01)

(52) U.S. Cl.
USPC ..... 206/521; 206/748

(58) Field of Classification Search
USPC ..... 206/521, 748, 747, 722, 523, 585, 591, 206/592, 522, 587; 220/4.23, 4.22
See application file for complete search history.

(56) References Cited

U.S. PATENT DOCUMENTS

| | | | | |
|---|---|---|---|---|
| 1,876,063 | A * | 9/1932 | Ferdinand Kronenberger | 206/521.6 |
| 2,863,595 | A | 12/1958 | Emery | |
| 5,226,543 | A * | 7/1993 | Foos et al. | 206/592 |
| 5,577,514 | A | 11/1996 | Palmeroni, Jr. et al. | |
| 6,321,911 | B1 * | 11/2001 | Raimer et al. | 206/509 |
| 6,786,334 | B2 * | 9/2004 | Smith | 206/592 |
| 6,820,743 | B2 * | 11/2004 | Hurley et al. | 206/427 |
| 6,877,608 | B2 * | 4/2005 | Koike | 206/592 |
| D523,338 | S * | 6/2006 | Hoge et al. | D9/456 |
| 7,328,800 | B2 * | 2/2008 | Koike | 206/521 |
| 7,743,922 | B2 | 6/2010 | Pitt | |
| 2001/0020595 | A1 * | 9/2001 | Koike | 206/521 |
| 2007/0175777 | A1 * | 8/2007 | Imai | 206/308.3 |
| 2007/0272577 | A1 * | 11/2007 | Kim | 206/470 |
| 2008/0067105 | A1 * | 3/2008 | Pitt | 206/587 |
| 2009/0230016 | A1 | 9/2009 | Rohrbach et al. | |
| 2011/0233099 | A1 * | 9/2011 | Pitt | 206/521 |

FOREIGN PATENT DOCUMENTS

| | | | |
|---|---|---|---|
| GB | 2414728 | A | 12/2005 |
| WO | 2005/118423 | A2 | 12/2010 |

* cited by examiner

*Primary Examiner* — Steven A. Reynolds
(74) *Attorney, Agent, or Firm* — Davis & Bujold, PLLC; Michael J. Bujold

(57) ABSTRACT

A thermoformed packaging case has four wall-flanges which abut in ridge-within-groove nesting for interlocking and shock-absorbing closure of the case. Each edge has a pattern of ridges and grooves, and nesting of the edges of the flanges is enabled by a lateral shift in its ridge-groove pattern. Articles contained within the case are cushioned from shock by projections which protrude inwardly from inner surfaces of the walls to resiliently bear against the articles. Each buffer has a top surface surrounded by a valley and hump to provide shock-absorbing resilience. Locking of the case involves a flap hinged to a side-wall. To close a top-wall of the case onto the side-wall, projections of the top-wall enter recesses of the side-wall, and by folding the flap over to insert the projections into reverse recesses of the projections. The projections are snapped into recesses to effect triple-locking of the flap.

11 Claims, 6 Drawing Sheets

SHOCK-PROTECTING PACKAGING

This application is a National Stage completion of PCT/GB2009/002414 filed Oct. 9, 2009, which claims priority from British patent application serial no. 0818508.4 filed Oct. 9, 2008.

FIELD OF THE INVENTION

This invention relates to packaging and is concerned particularly with packaging for use in protecting articles against damage and shock during storage and transit.

BACKGROUND OF THE INVENTION

Various packaging methods have been used for protecting, for example electronic components, during storage and transit. These methods, in addition to being generally labor-intensive, commonly involve a substantial outlay in cost and material-resources on packaging items in the form, for example, of cardboard cases and specially-designed items of plastics foam and corrugated cardboard to fit within them.

A form of packaging case that may be used with advantage environmentally and economically is described in GB-A-2414728. The rectangular packaging case described is of a thermoformed plastics-sheet construction having four walls that are hinged together to fold from flat in erection of the case round the article or articles to be protected. The walls have flanges at each end of the case that come into edge-to-edge abutment with one another in the erected case. The abutting edges of the flanges are each formed with ridges and grooves that run side-by-side with one another along the respective edge, and these ridges and grooves nest ridge-within-groove with the edge or edges of the other flanges abutted in the erected case. This mutual ridge-within-groove nesting is effective both for interlocking the abutting end-flanges and for cushioning or absorbing shock between them. In this way it contributes significantly to the integrity of the case for protection of the enclosed one or more articles.

There is, however, a limitation with the known form of packaging case on the extent to which the advantage of the mutual ridge-within-groove nesting can be achieved in practice between all flanges. In the case described, the ridges and grooves on the edges of two of the flanges opposite one another are not compatible with achieving nesting between them in that there is ridge-to-ridge alignment between them rather than the ridge-to-groove alignment required for nesting. There is in consequence a gap between those two flanges with the disadvantage that the benefits of interlocking and direct cushioning or absorption of shock between them is not realized.

SUMMARY OF THE INVENTION

It is one of the objects of the present invention to provide a form of thermoformed packaging case by which the above disadvantage can be overcome.

According to the present invention there is provided a thermoformed packaging case having walls which are for edge-to-edge abutment with one another and with mutual ridge-within-groove nesting between them, each of the abutting edges being formed with ridges with intervening grooves running side-by-side along the edge, and wherein the pattern of ridges with intervening grooves running along the edge of at least one of the walls includes a lateral shift or offset by which the ridges and grooves along a first part of the edge align with the grooves and ridges respectively along a second part of the edge.

The lateral shift or offset of the pattern along the edge enables that edge to be engaged in edge-to-edge abutment with full ridge-within-groove nesting with the edges of two other walls where that would not otherwise be possible. More especially, in the circumstances where the case has four walls, ridge-within-groove abutment of the edges of a first pair of them with one another and with the edges of the second pair, can be achieved by incorporating a lateral shift or offset of the pattern of ridges with intervening grooves in each of the second pair of edges. As an alternative, the same could be achieved by incorporating two lateral shifts or offsets in each of the second pair of edges.

The walls may be recessed on the inside to provide stepped, shock cushioning or absorbing projections on the outside of the case. Furthermore, the packaging case may include resilient projections or buffers which are formed in one or more walls of the case to project inwardly of the case from the one or more walls for contact with one or more articles within the case in exercising resilient restraint on such one or more articles.

According to another aspect of the invention there is provided a thermoformed packaging case for affording protection from shock for one or more articles contained within the case, wherein at least part of this protection is provided by resilient projections or buffers which are formed in one or more walls of the case to project inwardly of the case from the one or more walls into contact with the one or more articles for exercising resilient restraint on them within the case.

In the latter regard, the extent to which each buffer projects beyond its respective wall may be the same for all buffers but may vary from one buffer to another. By suitable choice of the extent of projection and variation of this from one location to another within the case, the case may be readily adapted to accommodate articles of irregular shape, and indeed may be adapted to accommodate together within the same case, articles of differing size and/or shape.

According to a further aspect of the invention there is provided a thermoformed assembly wherein a locking flap is hinged to a first part of the assembly for establishing locking closure between the first part and a second part of the assembly, the second part has a projection that enters a recess of the first part on closing of the first and second parts together, and a projection on the flap is adapted to be brought by hinging of the flap to snap into a reverse recess of the projection on the second part to effect the locking closure.

BRIEF DESCRIPTION OF THE DRAWINGS

Thermoformed packaging cases according to the various aspects of the invention will now be described, by way of example, with reference to the accompanying drawings, in which.

DETAILED DESCRIPTION OF THE PREFERRED EMBODIMENTS

Figure 1:
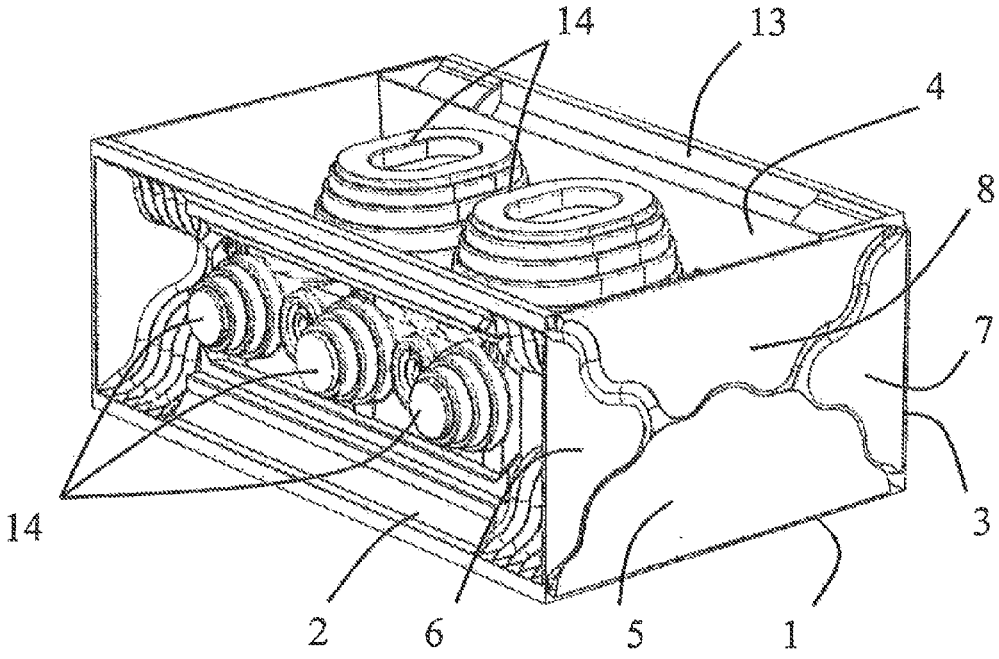
FIG. 1 is a perspective view of the thermoformed packaging case according to the invention, in its erected condition for affording protection to one or more articles contained therein.
Figure 2:
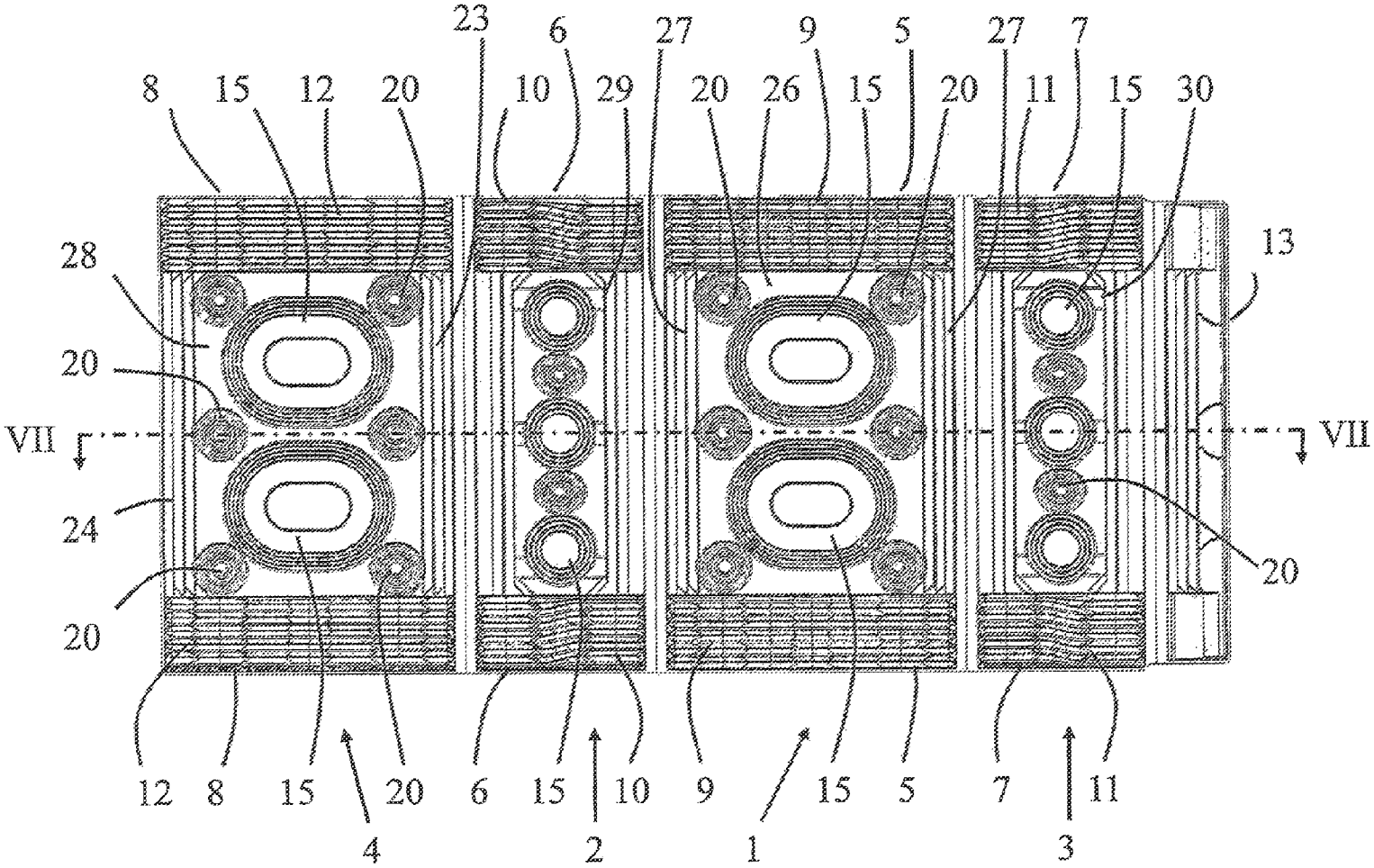
FIG. 2 is a plan view of the one-piece thermoformed sheet from which the packaging case of FIG. 1 is erected by folding.

Referring to FIG. 1, the erected packaging case of this example is of elongate rectangular form, being erected from the one-piece thermoformed sheet (for example of polypropylene) shown in FIG. 2, by folding round the one or more articles (not shown) to be protected. In the latter respect, and referring also to FIG. 2, the case has four substantially-rectangular walls, namely, a base-wall 1, two opposite side-walls 2 and 3, and a top-wall 4, that are hinged together longitudinally. The walls 1 to 4 have flanges 5 to 8 respectively that are upstanding from their two ends. The upper edges of the flanges 5 to 8 at each end are configured with respective patterns 9 to 12 of ridges with intervening grooves running side-by-side with one another along the edge.

Erection of the case from the flat condition of FIG. 2 to the erect condition shown in FIG. 1, is brought about by folding the side-wall 2 up from the base-wall 1 and then folding the top-wall 4 down from the side-wall 2 onto the side-wall 3 when the side-wall 3 has been folded up from the base-wall 1. The folding of the integrally-hinged walls 1 to 4 together in this way brings the flanges 5 to 8 into edge-to-edge abutment with one another. The edge of each flange 5 to 8 has a curvilinear profile that throughout the part of the edge-profile of each of the other flanges 5 to 8 with which it is in edge-to-edge abutment, matches closely the profile of that other flange, so that both ends of the case are closed. The case is locked in this fully-erected and closed condition by resilient engagement of a flap 13 hinged integrally to the side-wall 3, with the top-wall 4.

Figure 3:
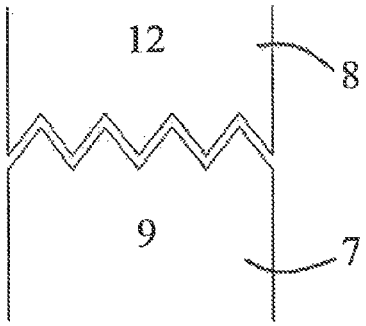
FIGS. 3 and 4 are schematic representations of cross-sectional views of ridge-groove patterns where, respectively, ridge-within-groove nesting occurs between the patterns and where it is precluded.
Figure 4:
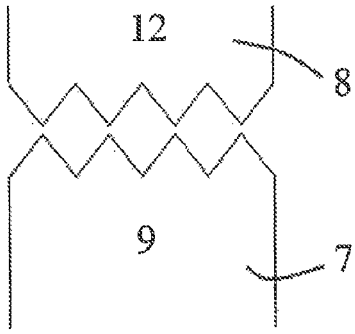

The edge-to-edge abutment between each flange 5 to 8 and each of those with which it in edge-to-edge abutment, is effective to interlock them with mutual ridge-within-groove nesting. More particularly, this interlocking and nesting occurs between the ridge-groove patterns 9 and 12 of flanges 5 and 8 respectively, and between each of the patterns 10 and 11 of the flanges 6 and 7 with each of the patterns 9 and 12 of the flanges 5 and 8 respectively. In order that there may be interlocking ridge-within-groove of patterns 9 and 12 of flanges 5 and 8 with one another, they are offset laterally with respect to one another by half the standard pattern-pitch. This is illustrated schematically by FIG. 3, whereas FIG. 4 is illustrative of interlocking being precluded in the circumstances where there is no such offset.

Figure 5:
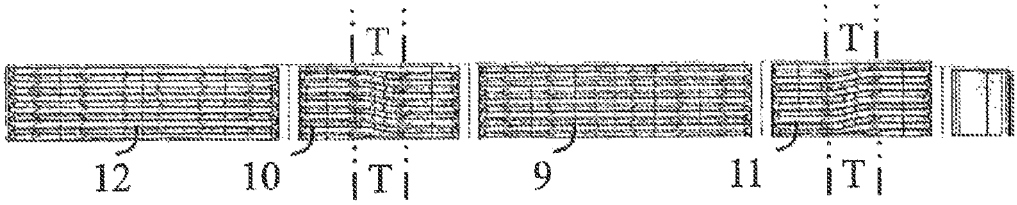
FIG. 5 is illustrative of ridge-groove patterns utilised in accordance with the present invention in the packaging case of FIG. 1.

However, each flange 6 and 7 is to interlock with both flanges 5 and 8 and the potential problem this creates is overcome according to the invention, as illustrated schematically in FIG. 5, by introducing into the ridge-groove patterns 10 and 11 of flanges 6 and 7, a transition T. Transition T incorporates into each pattern 10 and 11 a lateral shift or offset of one-half pitch mid-way along the abutment edge, to the effect that the ridges along one half of the pattern are aligned with the grooves along the other half. This accordingly allows the required ridge-within-groove interlocking to occur between each flange 6 and 7 and both flanges 5 and 8, and ensures that the enhanced cushioning or absorption of shock is realised for protection of the enclosed one or more articles.

It will be appreciated that transitions T producing lateral offsets of one-half pitch could be incorporated in the ridge-groove patterns of flanges 5 and 8 instead of in the patterns of flanges 6 and 7 to achieve the required interlocking at both ends of the case.

Referring again to FIGS. 1 and 2, each of the walls 1 to 4 of the packaging case incorporates projections 14 on the outside that result from recesses 15 of circular configuration formed on the inside of the case. The recesses 15 are of a tiered or stepped form having a diameter that decreases with depth, for cushioning the case and the one or more articles it contains, against shock. Additional cushioning of the one or more articles is provided by resilient projections or buffers 20 that project inwardly of the case from the insides of the walls 1. The profile of an example of a buffer 20 formed in a representative wall 21 of the case is illustrated by FIG. 6.

Figure 6:
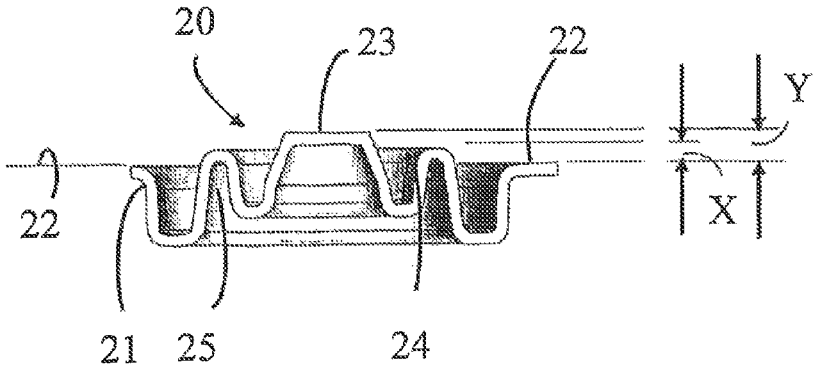
FIG. 6 is illustrative of the profile of a typical resilient projection or buffer used in accordance with the invention within the packaging case of FIG. 1.

Referring to FIG. 6, each buffer 20 is thermoformed in its respective wall 21 of the case to project above the inside surface 22 of the wall 21 by distance Y. The upper surface 23 of the buffer 20 contacts the contained article to support it clear of the surface 22. The configuration of the buffer-molding with the surrounding valley 24 and hump 25 within the wall 21, provides resilience for shock-absorbing protection to the supported article.

Where an article contained by the case is large enough to fill the space within the case, the article will bear on the inside surface 22 of the wall 21, the buffer 20, and others of the same form, will be compressed resiliently to such an extent that the top surface 23 is retracted down to the level of the surface 22. With any smaller article, the top surface 23 of the buffer 20, and the others of the same form, will be spaced above the surface 22 supporting it clear of that surface.

Figure 7:
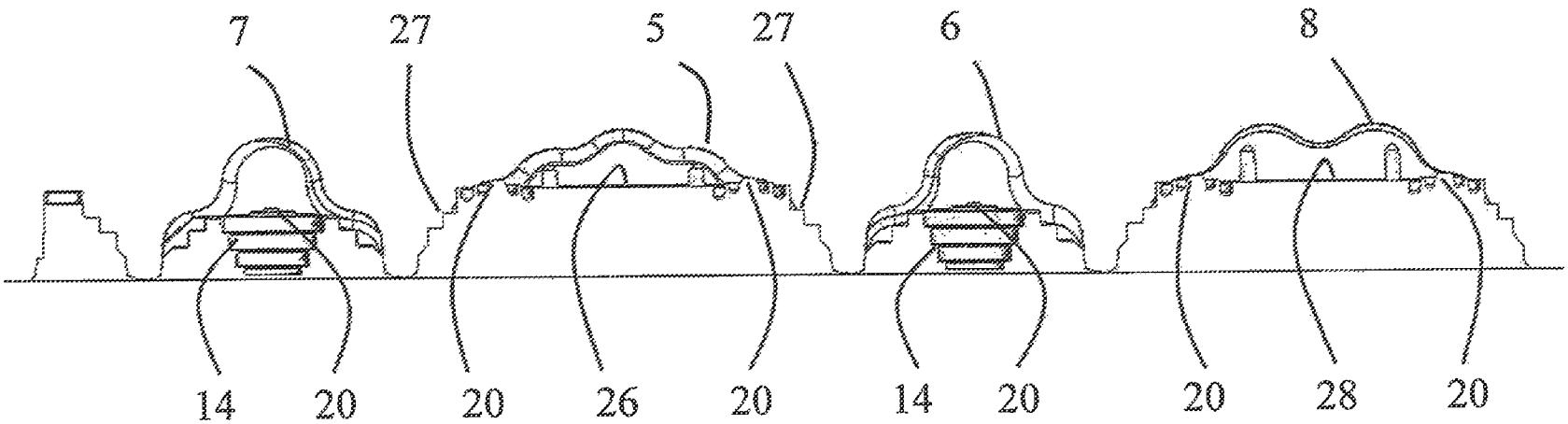
FIG. 7 is a section taken on the line VII-VII of FIG. 2.

Referring now also to FIG. 7, the inside surface of the base-wall 1 has a central, rectangular plinth-area 26 that rises up through steps 27 along the two longitudinal edges of the wall 1. The end-flanges 5 with their ridge-groove edge-configurations rise above the area 26, and the two large, circular recesses 15 are let into the area 26. Each of the recesses 15 are of a tiered form having a progressively decreasing diameter with depth to provide cushioning against shock. They also add to the strengthening provided by the steps 27 and the flanges 5 of the wall 1, and the corresponding features of the other walls 2 to 4.

The top-wall 4, which has a plinth-area 26, is configured in substantially the same way as the base-wall 1, and the side-walls 2 and 3 are configured with recesses 15 in their plinth-areas 29 and 30 respectively. Buffers 20 are located in all the plinth-areas 24, 26, 27 and 28.

The effectiveness of the buffer arrangement in providing shock-protection additional to that otherwise provided by the other features of the walls 1 to 4, depends on the extent to which the buffers 20 protrude above the plinth-areas 24, 26, 27 and 28 of those walls. In normal circumstances, the buffers 20 provide the primary shock-absorbing function in protecting against normal handling and transportation shocks, whereas the secondary shock-absorbing function provided by the other features including the recesses 15, act in conjunction with the buffers 20 to protect against major impacts.

The use of the resilient buffers has been described above in the context of the configuration of buffer 20 of FIG. 6, for which the encircling hump 25 lies below the inside surface 22 of the wall 21. With that configuration, for example, the distance Y may be 4 mm, and the overall diameter of the buffer may be some 25 mm with the top surface 23 having a diameter of 6 mm and the hump 25 a diameter of 10 mm. However, the configuration of buffer used may vary from that of FIG. 6. For example the hump 25 may itself project by 2 mm, above the inside surface 22 of the wall 21, so as possibly to provide a different characteristic of primary shock protection. Furthermore, more than just one surrounding hump 25 may be provided, and/or the top surface 23 may have an increased diameter, for example of 14 mm within a hump of 18 mm diameter.

As indicated above, the case of FIG. 1 is locked closed in the fully-erected condition by means of resilient engagement of the flap 13 with the top-wall 4. This form of locking, in particular in a form to provide a triple locking feature will be described in the context of a one-piece thermoformed sheet provided for another packaging case and illustrated in FIGS. 8 and 9.

Figure 9:
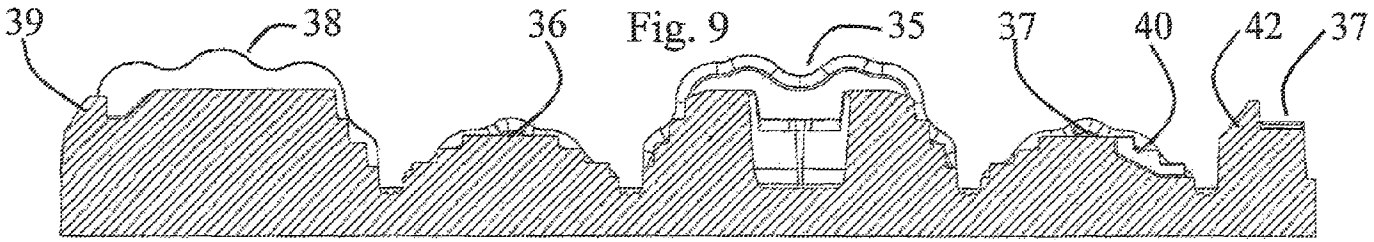
FIG. 9 is a section taken on the line IX-IX of FIG. 8.
Figure 8:
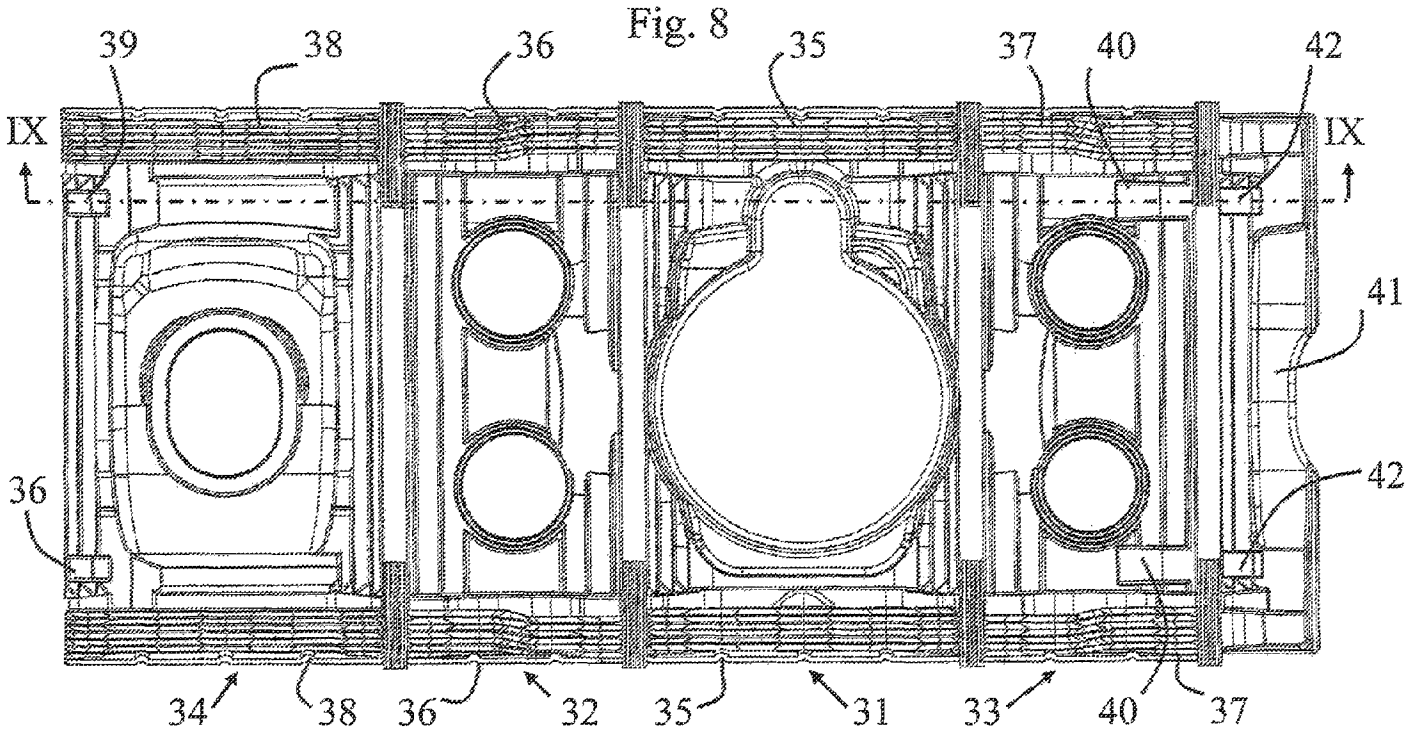
FIG. 8 is a plan view of a one-piece thermoformed sheet from which a second packaging case in accordance with the invention is erected by folding.

Referring to FIGS. 8 and 9, the case in this example has four substantially-rectangular walls, namely, a base-wall 31, side-walls 32 and 33, and a top-wall 34 that are hinged together longitudinally. For erection of the case from the flat form of FIG. 8, the side-walls 32 and 33 are folded up from the base-wall 31 and the top-wall 34 is then hinged over from the wall 32 to close onto the wall 33. The case is now locked in this closed condition with the end flanges 35 to 38 of the walls 31 to 34 respectively, abutting one another with mutual ridge-within-groove nesting. Locking of the case closed is carried out in the four-stage sequence illustrated at (a) to (d) of FIG. 10 (the sequence is illustrated as it would appear on the section line IX-IX).

Figure 10:
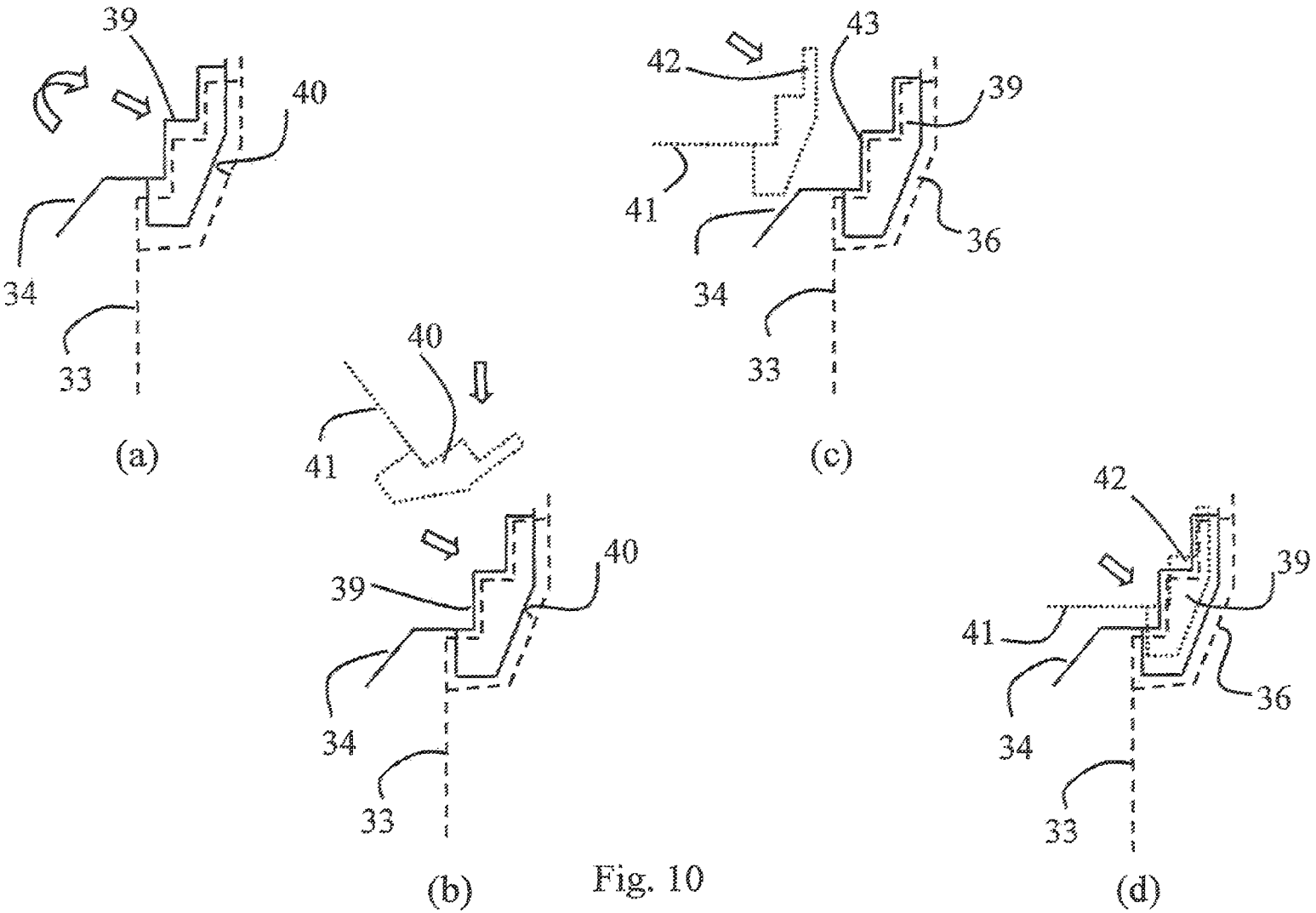
FIG. 10 is illustrative of successive stages (a) to (d) in the sequence for locking the second packaging case closed.

Referring to stage (a) of FIG. 10, the closing of the top-wall 34 onto the side-wall 33 is accompanied by entry of symmetrically-located thermoformed projections 39 which project from the inside of the wall 34, into respective recesses 40 in the inside of the wall 33. With the projections 39 pushed fully home within the recesses 40 as illustrated for stage (b) of FIG. 10, a locking flap 41 which is hinged to the wall 33, is folded over to overlap the junction between the walls 33 and 34. Stage (c) of FIG. 10 illustrates the folding down of the flap 41 to bring symmetrically-located thermoformed projections 42 that project from the underside of the folded-over flap 4 aligned with the projections 39 pushed into the recesses 40. More especially, the alignment brings the projections 42 facing into the reverse recesses 43 on the outside of the wall 34, of the thermoformed projections 39. In stage (d) of FIG. 10, the projections 42 are pushed home into the recesses 43 for resilient retention there locking the case firmly closed. Retention of the case in the locked condition is enhanced by virtue of each projection 42 being an interference fit with a snap action into an undercut of its recess 43; the snap action is facilitated by the resilience of the thermoformed material.

The invention claimed is:

1. A thermoformed packaging case comprising first and second walls which are for edge-to-edge abutment with one another and with mutual ridge-within-groove nesting between them, each of the first and second walls having an edge that is formed with a pattern of ridges with intervening grooves running side-by-side along the edge, and the pattern of ridges with intervening grooves running along the edge of the first wall includes a lateral offset by which the ridges along a first part of the edge of the first wall are aligned with the grooves along a second part of the edge of the first wall while the grooves along the first part of the edge of the first wall are aligned with the ridges along the second part of the edge of the first wall; and the pattern of ridges with intervening grooves running along the edge of the second wall nest ridge-within-groove with the grooves and the ridges respectively of the second part of the first wall.

2. The thermoformed packaging case according to claim 1, wherein the abutting edges are edges of flanges to the walls.

3. The thermoformed packaging case according to claim 2, wherein each of one or more of the flanges has a curvilinear edge-profile.

4. The thermoformed packaging case according to claim 2, wherein the walls are rectangular and the flanges are upstanding from ends of the walls.

5. The thermoformed packaging case according to claim 4, wherein the walls are hinged longitudinally to one another for erection of the case from a flat form.

6. The thermoformed packaging case according to claim 1, wherein the case includes third and fourth walls which are for edge-to-edge abutment with one another and with the second and first walls respectively, each of the third and fourth walls having an edge that is formed with a pattern of ridges with intervening grooves running side-by-side along the edge, and the pattern of ridges with intervening grooves running along the edge of the third wall includes a lateral offset by which the ridges along a first part of the edge of the third wall are aligned with the grooves along a second part of the edge of the third wall while the grooves along the first part of the edge of the third wall are aligned with the ridges along the second part of the edge of the third wall, and the pattern of ridges with intervening grooves running along the edge of the fourth wall nest ridge-within-groove with the grooves and the ridges respectively of the second part of the third wall, and with the grooves and ridges respectively of the first part of the first wall.

7. The thermoformed packaging case according to claim 1, wherein the walls are recessed on an inside to provide stepped projections on an outside of the case.

8. The thermoformed packaging case according to claim 1, including resilient buffers which are formed in at least one of the walls of the case to project therefrom inwardly of the case for contact with one or more articles within the case in exercising resilient restraint on the one or more articles.

9. The thermoformed packaging case according to claim 1, wherein a locking flap is hinged to a first wall of a pair of the walls for establishing locking closure between the first wall and a second wall of the pair of walls, the second wall of the pair of walls has a projection that enters a recess of the first wall of the pair of walls on closing of the first and the second walls of the pair of walls together, and a projection on the flap is adapted to be brought by hinging of the flap to snap into a reverse recess of the projection on the second wall of the pair of walls to effect the locking closure.

10. The thermoformed packaging case according to claim 8, wherein an extent to which each of the buffers projects beyond its respective wall is identical for all of the buffers.

11. The thermoformed packaging case according to claim 8, wherein the extent to which the buffers project beyond their respective walls varies between different ones of the buffers.

* * * * *